United States Patent [19]

Tomanovits

[11] Patent Number: 5,066,270

[45] Date of Patent: Nov. 19, 1991

[54] APPARATUS FOR FORMING INNERFRAME FOR CIGARETTE PACK WITH ROUNDED CORNERS

[75] Inventor: John Tomanovits, Richmond, Va.

[73] Assignee: Philip Morris Inc., New York, N.Y.

[21] Appl. No.: 585,224

[22] Filed: Sep. 19, 1990

[51] Int. Cl.[5] ..... B31B 3/26; B31B 7/26

[52] U.S. Cl. ..... 493/435; 493/178; 493/295

[58] Field of Search ..... 493/178, 179, 295, 435, 493/438, 910, 911

[56] References Cited

U.S. PATENT DOCUMENTS

| | | | |
|---|---|---|---|
| 3,398,660 | 8/1968 | Watrous | 493/178 |
| 4,596,112 | 6/1986 | Buckley et al. | 53/476 |
| 4,708,704 | 11/1987 | Focke et al. | 493/151 |
| 4,730,442 | 3/1988 | Focke et al. | 53/579 |
| 4,753,383 | 6/1988 | Focke et al. | 229/160.1 |
| 4,753,384 | 6/1988 | Focke et al. | 229/160.1 |
| 4,843,798 | 7/1989 | Focke et al. | 53/453 |

FOREIGN PATENT DOCUMENTS

| | | |
|---|---|---|
| 3615827 | 11/1987 | Fed. Rep. of Germany . |
| 3615828 | 11/1987 | Fed. Rep. of Germany . |

*Primary Examiner*—William E. Terrell

*Attorney, Agent, or Firm*—Robert R. Jackson

[57] ABSTRACT

Apparatus is shown for preforming a rounded-corner C-shaped innerframe for use in a rounded corner cigarette pack. Contoured rollers are used to preform the rounded corners in the innerframe.

14 Claims, 7 Drawing Sheets

APPARATUS FOR FORMING INNERFRAME FOR CIGARETTE PACK WITH ROUNDED CORNERS

BACKGROUND OF THE INVENTION

This invention relates to cigarette packs with rounded corners, and more particularly to apparatus for forming innerframes for such packs.

There is increasing interest in cardboard cigarette packs with rounded corners. Many consumers prefer the sturdiness of cardboard packs, and rounded corners have such additional advantages as giving the pack a better feel in the hand and reducing wear on the garment, handbag, or whatever else the pack is carried in.

Square-cornered cardboard packs often have a lid which is hinged to the back of the pack so that the pack can be opened by pivoting the lid back and then reclosed by pivoting the lid forward again. A cardboard innerframe is typically provided between the foil-wrapped cigarettes and the cardboard outer container. This innerframe usually has a broad-based U shape when viewed from the top of the pack. The base of this U shape is at the front of the pack, and the two legs of the U are at the respective sides of the pack. This innerframe increases the strength of the pack and, by interfering somewhat with the hinged lid as it is opened and closed, helps to keep the lid neatly, firmly, and fully closed except when deliberately opened by the consumer.

It has been found that U-shaped innerframes of the type described above do not work as well in packs with rounded corners. Perhaps because of the rounded corners of the outer container, a U-shaped innerframe does not fit as firmly or immovably in rounded corner packs. Without such a firm and immovable fit, the innerframe does not strengthen the pack as well or operate as well to keep the hinged lid firmly and completely closed.

In view of the foregoing, it is an object of this invention to provide apparatus for producing improved innerframes for cigarette packs with rounded corners.

It is another object of this invention to provide apparatus for producing innerframes having a rounded-corner C shape rather than a U shape.

SUMMARY OF THE INVENTION

These and other objects of the invention are accomplished in accordance with the principles of the invention by providing apparatus having two successive sets of contoured rollers. An innerframe blank, which is preferably already scored with several closely spaced parallel score lines in each of four regions where the innerframe will have a rounded corner in the finished pack, is fed through the nips between the roller sets parallel to the longitudinal axes of the score lines. The first set of contoured rollers pinches and shapes the innerframe blank so as to cause two of the four corner regions to "set" with approximately the desired final curvature of innerframe corners. Thereafter, the second set of contoured rollers pinches and shapes the innerframe blank so as to cause the remaining two corner regions to "set" with approximately the same curvature as the first two corner regions. The end result is a generally C-shaped innerframe which can be put in a rounded-corner pack with rear end flaps in face-to-face contact with the rear of the pack. This provides a sturdier innerframe in a rounded corner pack, and because the innerframe is sturdier, it is better able to strengthen the pack and keep the hinged lid firmly and neatly closed.

Further features of the invention, its nature and various advantages will be more apparent from the accompanying drawings and the following detailed description of the preferred embodiments.

DETAILED DESCRIPTION OF THE PREFERRED EMBODIMENT

Figure 1:
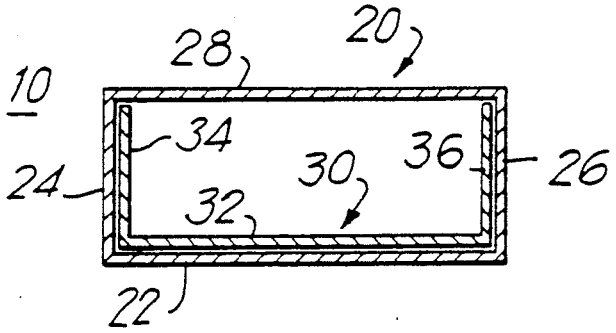
FIG. 1 PRIOR ART
FIG. 1 is a simplified top sectional view of a typical prior art square-cornered cigarette pack. For simplicity, the outer container is shown just as a plain annulus, without the usual overlapping tabs.
Figure 2:
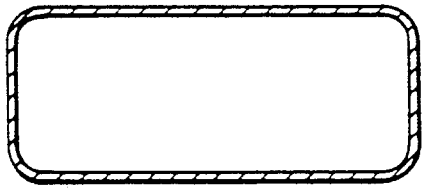
FIG. 2 is similar to FIG. 1 but shows the outer container of a typical rounded-corner cigarette pack.
Figure 3:
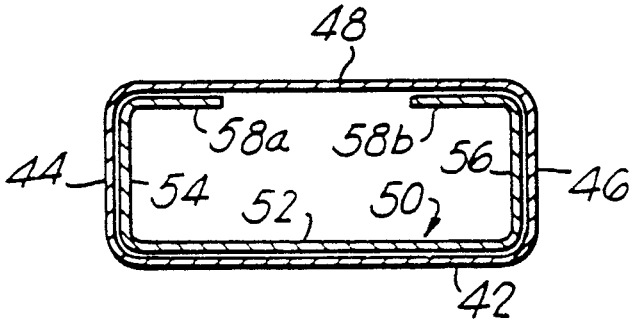
FIG. 3 is another view similar to FIG. 1 but shows a rounded-corner cigarette pack including a rounded-corner C-shaped innerframe in accordance with this invention.

As shown in FIG. 1, the typical square-cornered cardboard cigarette pack 10 has a cardboard outer container 20 and a U-shaped cardboard innerframe 30. The base 32 of this U shape is adjacent the front 22 of the outer container. The two legs 34 and 36 of the U are respectively adjacent the side walls 24 and 26 of the outer container. The rear 28 of the outer container is without any adjacent portion of the innerframe except possibly for the free ends of legs 34 and 36 of the U. Nevertheless, in this structure the innerframe is sufficiently braced against the outer container that it amply performs its functions of strengthening the outer container and keeping the hinged lid (not shown) closed. However, when the corners of the outer container are rounded, as shown for example in FIG. 2. A U-shaped innerframe does not perform these functions nearly as well. In these packs a C-shaped innerframe 50 as shown in FIG. 3 has been found to perform much better. The back 52 of the C is again adjacent the front 42 of the pack. The top 54 and bottom 56 of the C are respectively adjacent the sides 44 and 46 of the pack. The return legs **58*a* and 58*b* of the C are adjacent the rear 48 of the pack. All vertical edges or corners of both the outer container and the innerframe are curved, typically to conform approximately to the cylindrical surface of the cigarettes in the corners of the pack. The apparatus of this invention forms innerframes such as innerframe 50** into the required C shape.

Figure 4:
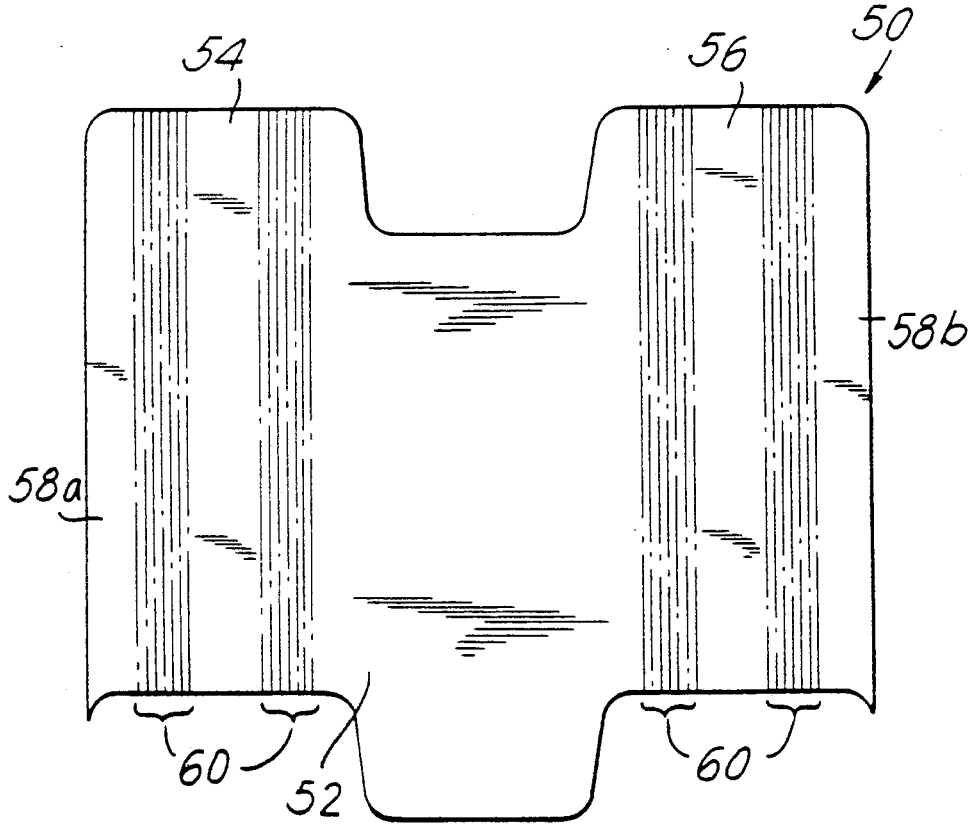
FIG. 4 shows an innerframe blank prior to bending in accordance with this invention.

FIG. 4 shows a typical innerframe 50 after cutting and scoring but prior to forming in accordance with this invention. The top of the innerframe as viewed in FIG. 4 is the top of the innerframe in the finished pack. The scoring of innerframe 50 is indicated by lines 60. Note that there are four separate scored regions, one where each rounded corner will be in the finished pack. The scoring helps produce corners of relatively smooth roundness and also makes it easier for the apparatus of this invention to form the innerframe into the desired rounded-corner C shape.

Figure 5:
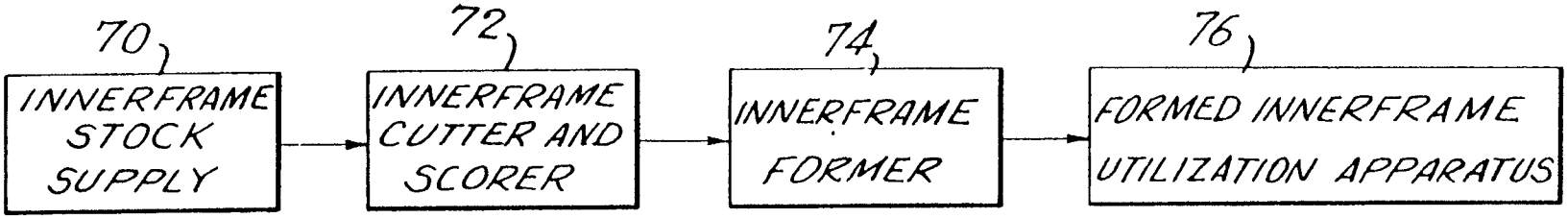
FIG. 5 is a block diagram of illustrative apparatus for making, forming, and utilizing the blank of FIG. 4 in accordance with this invention.
Figure 6:
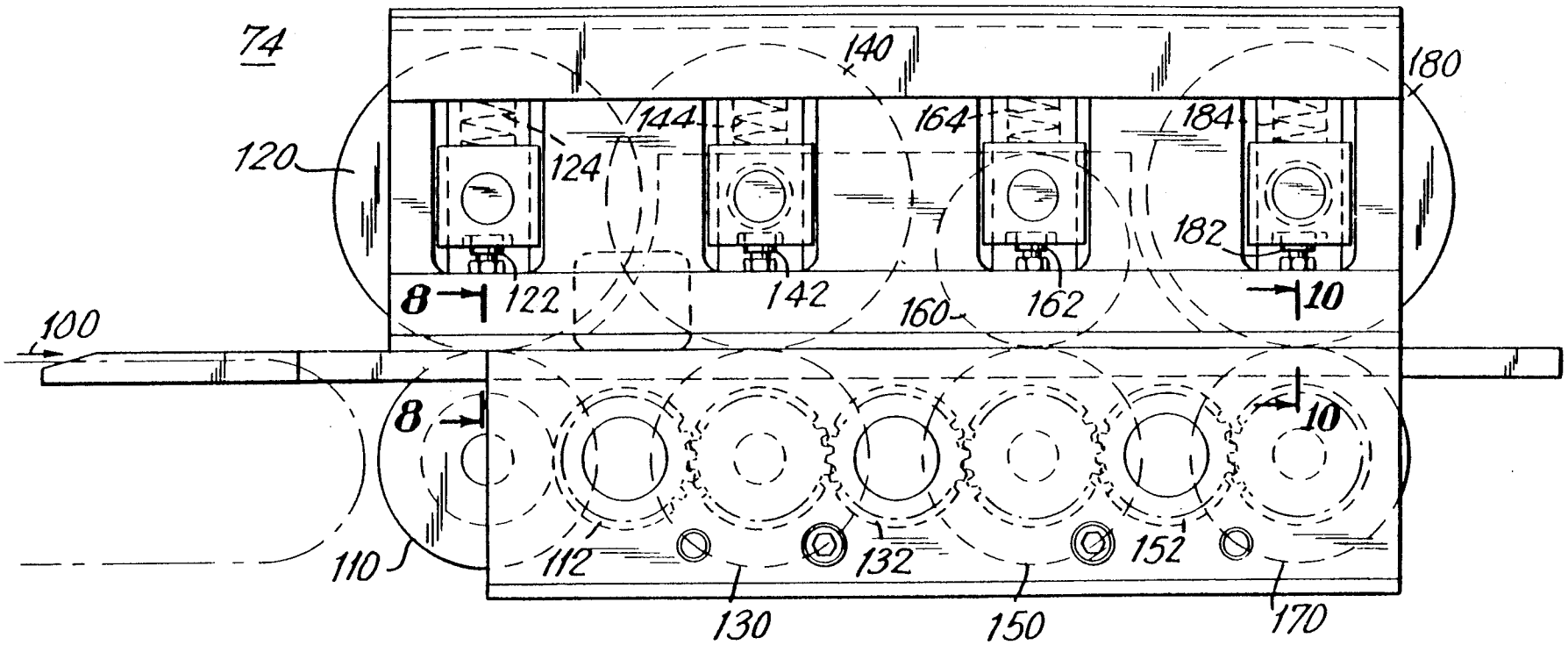
FIG. 6 is an elevational view of a portion of the apparatus of FIG. 5.

The apparatus of this invention typically forms one part of a cigarette packaging line as shown, for example, in FIG. 5. The innerframe material is supplied from supply 70, which may be a continuous web of innerframe material wound in a reel or mandrel. The innerframe material is unwound from the reel and passed through cutter and scorer 72 parallel to the score lines 60 made in the innerframes by element 72. Cutter and scorer 72 scores the innerframe material lengthwise (as indicated by lines 60) and cuts it transversely into individual innerframes 50 as shown in FIG. 4. The individual innerframes 50 are then fed one after another to innerframe former 74 which gives each innerframe the desired rounded-corner C shape. A preferred embodiment of innerframe former 74 is shown in more detail in FIGS. 6–8 and 10 and described in more detail below. From former 74, the innerframes are conveyed to apparatus 76 which uses them to produce finished cigarette packs of the type shown in FIG. 3. Although apparatus 76 may take other forms, a preferred form of this apparatus is shown in concurrently filed, commonly assigned U.S. patent application Ser. No. 584,803, U.S. Pat. No. 5,035,102, which is hereby incorporated by reference herein, and which also shows and describes more details regarding elements 70 and 72 as well.

As has been mentioned, a preferred embodiment of innerframe former 74 is shown in FIGS. 6–8 and 10. Substantially flat innerframe blanks 50 enter this apparatus (as indicated by the arrow 100) from the left as viewed in FIGS. 6 and 7. In the preferred embodiment, the bottom edge of each blank 50 as viewed in FIG. 4 is the leading edge of the blank going into the apparatus. The plane of each blank 50 is perpendicular to the plane of the paper in FIG. 6, and parallel to the plane of the paper in FIG. 7. Score lines 60 are parallel to arrow 100.

Innerframe former 74 includes four sets of rollers which successively operate on each blank 50. (Although each of the "rollers" referred to herein may in fact be made up of two or more axially adjacent portions, it will be more convenient herein to refer to all of these portions as a single roller.) Each roller set includes a driven lower roller 110, 130, 150, and 170, respectively, and an idling upper roller 120, 140, 160, and 180, respectively. Adjacent lower rollers 110, 130, 150, and 170 are drivingly interconnected by intervening spur gears 112, 132, and 152 so that all of the lower rollers can be driven in the same direction at the same speed from one shaft.

Each of idling upper rollers 120, 140, 160, and 180 is mounted for limited vertical motion. In particular, each upper roller is urged downwardly against associated stops 122, 142, 162, and 182 by associated prestressed compression coil springs 124, 144, 164, and 184, respectively. Each upper roller has a stop and a spring adjacent each end of the shaft on which the roller is mounted. Stops 124, 144, 164, and 184 are vertically adjustable so that the nominal clearance between the upper and lower rollers in each set can be adjusted. For example, when processing innerframe blanks 50 having a thickness of 0.012 inches, it has been found satisfactory to set stops 124, 144, 164, and 184 so that the nominal clearance between the upper and lower rollers in each set is approximately 0.006 inches. This means that innerframe blanks 50 are pinched between the upper and lower rollers as the blanks 50 pass through the nips between these rollers. The pinching force is determined by the weight of the upper rollers and the downward force exerted by springs 124, 144, 164, and 184. Upper rollers 120, 140, 160, and 180 move up slightly against the downward force of springs 124, 144, 164, and 184 as innerframe blanks 50 pass through the roller nips.

Figure 8:
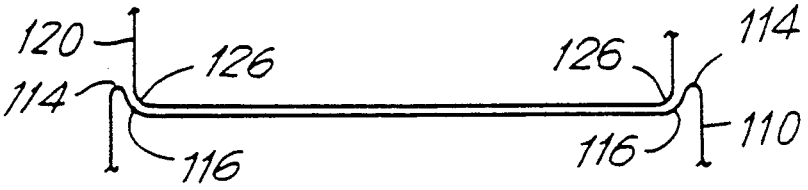
FIG. 8 is a simplified partial sectional view taken along the line 8—8 in FIG. 6.
Figure 9:
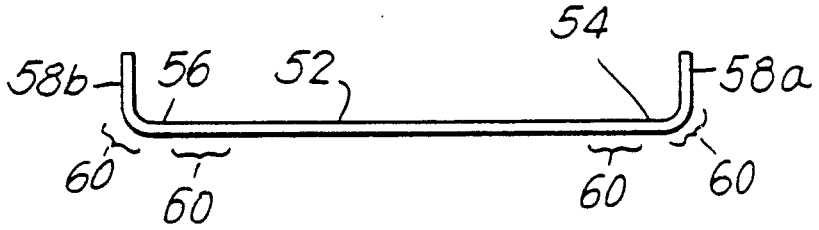
FIG. 9 shows an innerframe as it passes through the of the apparatus shown in FIG. 8.

Rollers 110 and 120 cooperate to bend each innerframe blank 50 into a rounded-corner U-shape, with the rounded corners occurring at the score lines 60 between blank portions 58*a* and 54, and between blank portions 56 and 58*b*. FIG. 8 shows the shape of the nip between rollers 110 and 120 which produces this deformation, and FIG. 9 shows a blank 50 after passing through this nip. As can be seen in FIG. 8, the axial end edges 126 of upper roller 120 are radially inwardly rounded. These axial end edges are aligned with the score lines 60 at which innerframe blank 50 is to be deformed at this nip. The adjacent axial ends of roller 110 have radially outwardly extending flanges 114 which are axially just beyond upper roller end edges 126. The surface of each flange 114 which is opposite end edge 126 is rounded (as at 116) to complement that end edge. Accordingly, as each blank 50 passes through the nip between rollers 110 and 120, this nip deforms the blank to the shape shown in FIG. 9. Flaps 58 may be initially guided up toward the axial ends of roller 110 by appropriately shaped stationary plows 104*a* and 104*b*.

Figure 7:
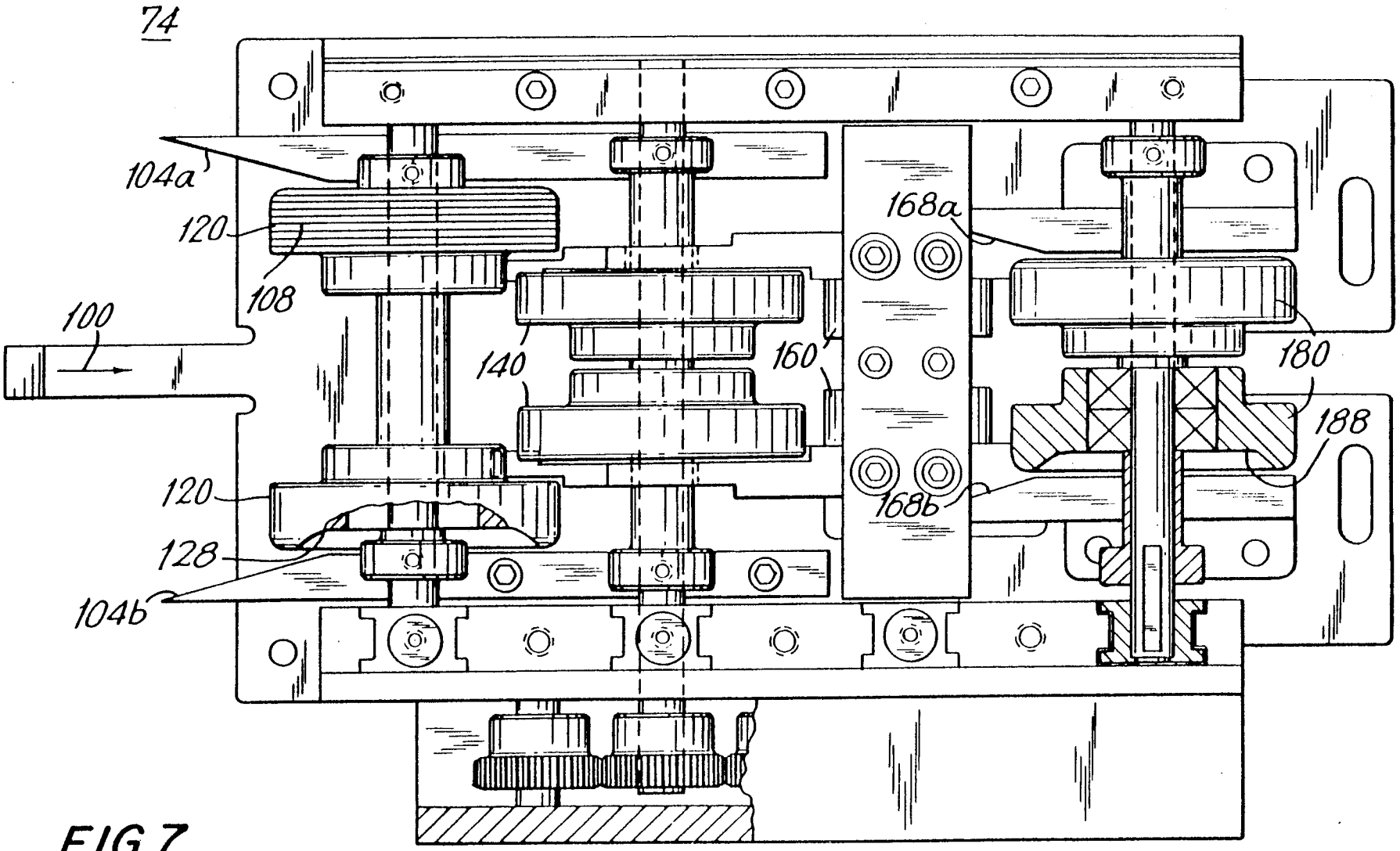
FIG. 7 is a plan view, partly in section of the apparatus of FIG. 6.
Figure 13:
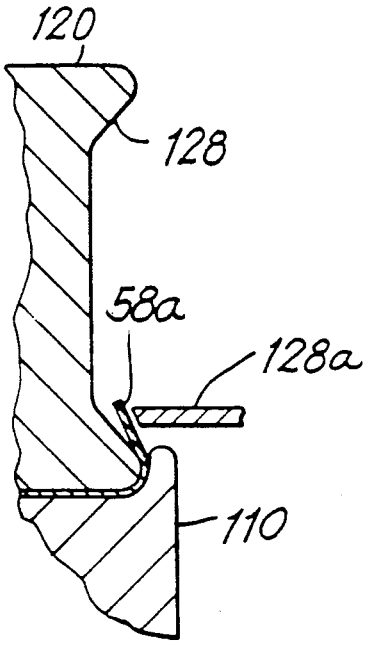
FIG. 13 is a view similar to a portion of FIG. 8 showing optional additional apparatus in accordance with this invention.

As can be seen in FIG. 7, each axial end of roller 120 may be recessed as indicated at 128. This allows optional use of a stationary finger 128*a* (FIG. 13) to push the innerframe into recess 128 to achieve even greater breaking of the innerframe blank at the rounded corners formed as the innerframe passes between rollers 110 and 120.

After passing through the nip between contoured rollers 110 and 120, each innerframe blank 50 passes through the nip between rollers 130 and 140, and then through the nip between rollers 150 and 160. These rollers do not do any further shaping of the blank, but merely serve to advance the blank from rollers 110 and 120 to rollers 170 and 180. In order to avoid undoing the shaping work done by rollers 110 and 120, rollers 130, 140, 150, and 160 contact only the portions 52, 54, and 56 of each blank 50 which remain in the original plane of the blank.

Figure 10:
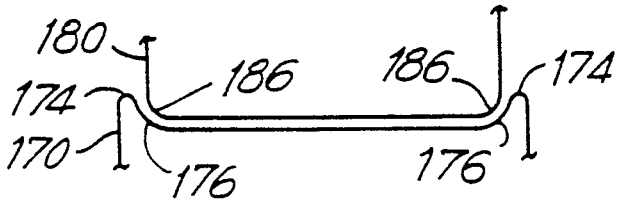
FIG. 10 is a simplified partial sectional view taken along the line 10—10 in FIG. 6.
Figure 11:
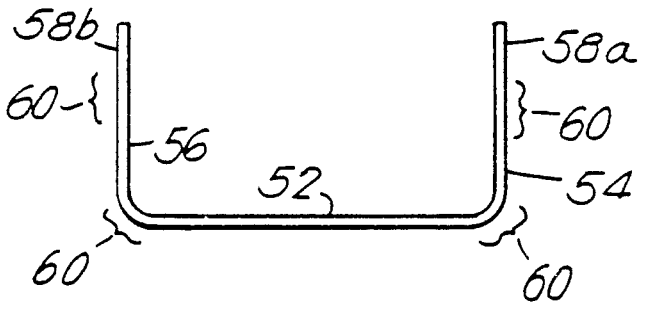
FIG. 11 shows an innerframe as it passes through the section of the apparatus shown in FIG. 10.
Figure 12:
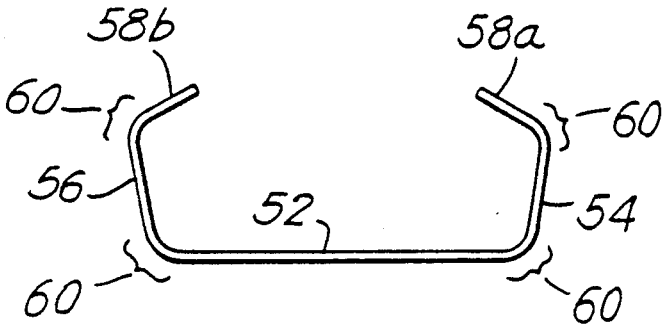
FIG. 12 is a view similar to FIG. 11, but shows an innerframe after it has exited from the apparatus shown FIGS. 6–8 and 10.

As shown in FIG. 10, rollers 170 and 180 have contours respectively similar to rollers 110 and 120, except that the rounded axial end edges 186 of roller 180 and the flanges 174 of roller 170 are axially closer together and aligned with the score lines 60 adjacent each side of the central portion 52 of each blank. Accordingly, rollers 170 and 180 deform each blank 50 as shown in FIG. 11 as the blank passes through the nip between these rollers. In particular, rollers 170 and 180 produce rounded corners in the blank at the score lines 60 along each side of the central portion 52 of the blank. As the blank passes through the nip between rollers 170 and 180, the previously formed rounded corners inside blank portions 58 tend to flatten out. But these rounded corners reappear when the blank exits from apparatus 74 as shown in FIG. 12. As in the case of rollers 110 and 120, the portions of each blank beyond central portion 52 may be initially guided up for better feeding into the contoured nip between rollers 170 and 180 by appropriately shaped stationary plows 168*a* and 168*b*. As in the case of roller 120, the axial ends of roller 180 are recessed as indicated at 188 in FIG. 7 so that the technique illustrated in FIG. 13 can again be applied at this point if desired.

In order to promote straight feeding of the blanks, it has been found desirable to provide shallow circumferential grooves in all of rollers 110, 120, 130, 140, 150, 160, 170, and 180. Representative grooves 118 are shown on roller 120 in FIG. 7.

As has been mentioned, the blanks exiting from innerframe former 74 with the shape shown in FIG. 12 are conveyed on to innerframe utilization apparatus 76 where the innerframes are appropriately incorporated in finished rounded-corner cigarette packs.

It will be understood that the foregoing is merely illustrative of the principles of this invention, and that various modifications can be made by those skilled in the art without departing from the scope and spirit of the invention. For example, although in the depicted embodiment innerframe blanks 50 are curved upwardly as they pass through innerframe former 74, they could alternatively be curved downwardly. As another alternative, the upper rollers could be the driven rollers and the lower rollers could be the idling and spring-biased rollers.

The invention claimed is

1. Apparatus for forming an innerframe for a cigarette package, said innerframe having a generally C-shaped cross section including a front surface portion, two side surface portions, and two rear flap portions, the front surface portion being between said side surface portions, and each of said side surface portions being between the front surface portion and a respective one of said rear flap portions, said front surface portion being joined to each of said side surface portions by a first corner region including a plurality of closely spaced score lines substantially parallel to the axis about which said innerframe will be bent between said front surface portion and said side surface portion, and each of said side surface portions being joined to the adjacent rear flap portion by a second corner region including a plurality of closely spaced score lines substantially parallel to the axis about which said innerframe will be bent between said side surface portion and said rear flap portion, said apparatus comprising:

a first roller having radially inwardly rounded axial end edges, the axial distance between said axial end edges corresponding to the spacing between said second corner regions, and the inward curvature of said rounded axial end edges corresponding to the curvature desired for said second corner regions;

a second roller cooperating with said first roller to form a first nip, said second roller having radially outwardly extending axial end flanges, each of said axial end flanges being axially beyond but adjacent to a respective one of the axial end edges of said first roller, and the surface of each flange opposite said rounded end edge being rounded to complement the associated rounded end edge of said first roller;

means for feeding said innerframe to said first nip with each of said second corner regions aligned with a respective one of said rounded end edges so that as said innerframe passes through said first nip, said rounded end edges and the adjacent rounded flange surfaces cooperate to bend each of said second corner regions to the desired curvature;

a third roller having radially inwardly rounded axial end edges, the axial distance between the axial end edges of said third roller corresponding to the spacing between said first corner regions, and the inward curvature of said rounded axial end edges corresponding to the curvature desired for said first corner regions;

a fourth roller cooperating with said third roller to form a second nip, said fourth roller having radially outwardly extending axial end flanges, each of the axial end flanges of said fourth roller being axially beyond but adjacent to a respective one of the axial end edges of said third roller, and the surface of each flange opposite a rounded end edge of said third roller being rounded to complement the associated rounded end edge of said third roller; and means for feeding said innerframe to said second nip with each of said first corner regions aligned with a respective one of said rounded end edges of said third roller so that as said innerframe passes through said second nip, the rounded end edges of said third roller and the adjacent rounded flange surfaces of said fourth roller cooperate to bend each of said first corner regions to the desired curvature.

2. The apparatus defined in claim 1 further comprising:

means for resiliently biasing at least one of said first and second rollers toward the other of said first and second rollers.

3. The apparatus defined in claim 2 further comprising:

stop means for preventing said at least one of said first and second rollers from coming closer than a predetermined distance to said other of said first and second rollers.

4. The apparatus defined in claim 3 wherein said stop means is adjustable to allow adjustment of said predetermined distance.

5. The apparatus defined in claim 3 wherein said predetermined distance is less than the thickness of said innerframe.

6. The apparatus defined in claim 1 wherein one of said first and second rollers is driven to rotate and the other of said first and second rollers is an idler roller.

7. The apparatus defined in claim 1 further comprising:

means for resiliently biasing said other of said first and second rollers toward said one of said first and second rollers.

8. The apparatus defined in claim 7 further comprising:

stop means for preventing said other of said first and second rollers from coming closer than a predetermined distance to said one of said first and second rollers.

9. The apparatus defined in claim 8 wherein said stop means is adjustable to allow adjustment of said predetermined distance.

10. The apparatus defined in claim 8 wherein said predetermined distance is less than the thickness of said innerframe.

11. The apparatus defined in claim 1 wherein at least one of said rollers has a plurality of circumferential grooves.

12. The apparatus defined in claim 1 further comprising:

plow means in advance of said first nip for contacting said rear flap portions and deflecting said rear flap portions toward the positions they will have after passing through said first nip.

13. The apparatus defined in claim 1 further comprising:

plow means after said first nip but before said second nip for contacting said side surface portions and deflecting said side surface portions toward the positions they will have after passing through said second nip.

14. The apparatus defined in claim 1 wherein the axial ends of at least one of said first and third are recessed, and wherein said apparatus further comprises:

means for pushing portions of said innerframe which are adjacent said recessed axial ends into said recessed axial ends.

* * * * *